US012674262B1

(12) United States Patent
Ellis

(10) Patent No.: US 12,674,262 B1
(45) Date of Patent: Jul. 7, 2026

(54) EXPANSION JOINT MOUNT

(71) Applicant: Michael A. Ellis, Lookout Mtn, GA (US)

(72) Inventor: Michael A. Ellis, Lookout Mtn, GA (US)

( * ) Notice: Subject to any disclaimer, the term of this patent is extended or adjusted under 35 U.S.C. 154(b) by 0 days.

(21) Appl. No.: 19/292,285

(22) Filed: Aug. 6, 2025

(51) Int. Cl.
*D06C 3/02* (2006.01)

(52) U.S. Cl.
CPC ..... *D06C 3/025* (2013.01)

(58) Field of Classification Search
CPC ..... D06C 3/026; D06C 3/02; D06C 3/023; D06C 3/08; D06C 3/00; D06C 2700/10
USPC ..... 26/76, 53
See application file for complete search history.

(56) References Cited

U.S. PATENT DOCUMENTS 1,734,897 A * 11/1929 Cluett ..... D06C 7/02 26/72
1,746,473 A * 2/1930 Hoey ..... B65H 23/028 26/52
2,482,270 A * 9/1949 Grundy ..... D06C 3/00 26/72
3,430,310 A * 3/1969 Richbourg ..... D06C 3/00 26/51.3
3,436,796 A * 4/1969 Coates ..... D06C 3/00 26/51.3
3,552,248 A * 1/1971 Pernick ..... D06C 3/02 26/96
3,571,846 A * 3/1971 Tomlinson ..... B29C 55/165 425/66
3,598,371 A * 8/1971 Hyatt ..... B29C 55/20 26/91
4,080,692 A * 3/1978 Parrillo ..... D06C 3/04 26/91
4,171,774 A 10/1979 Deslauriers
4,497,096 A * 2/1985 Richter ..... D06C 3/02 26/89
5,255,419 A * 10/1993 Stanislaw ..... D06C 3/02 26/84
7,073,237 B1 * 7/2006 Cavanagh ..... D06C 3/025 26/89
7,093,333 B2 * 8/2006 Lee ..... B65H 23/022 26/89
D619,864 S 7/2010 Ellis
2008/0134481 A1 * 6/2008 Catallo ..... D06C 3/025 26/89

* cited by examiner

*Primary Examiner* — Jillian K Pierorazio
(74) *Attorney, Agent, or Firm* — QuickPatents; Kevin Prince

(57) ABSTRACT

An expansion joint for use with a tenter system having at least two tenter chain and rail mechanisms adjustably separated by a width adjustment assembly. Each chain and rail mechanism includes at least two elongated sections of a tenter rail that conducts a tenter chain therein. The expansion joint includes a mounting bracket adapted for attachment to the width adjustment assembly of the tenter system and an elongated C-shaped rail cage adapted to substantially enclose abutting ends of each tenter rail section. The rail cage includes a partially open side through which pin plates fixed to the tenter chain may project as the chain moves through the tenter rail. The rail cage is adapted for fixing with the mounting bracket and receiving slidably through open ends thereof each end of one of the rail sections.

4 Claims, 4 Drawing Sheets

EXPANSION JOINT MOUNT

CROSS REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to tenter systems used in the manufacturing of carpet and other web materials, and more particularly to an expansion joint mounting apparatus for a tenter chain system.

BACKGROUND

The continuous industrial production of carpet or textile webs, including dying, printing, coating, drying, heat setting, curing, or otherwise conveying a tufted or woven fabric web of various widths, is a complex process that traditionally requires the use of a tenter frame. As a part of the manufacturing process of a tufted or woven material such as carpet, turf, floor coverings, or textile web it is necessary that the fabric be placed continually onto tenter pin plates or clips mounted on two parallel endless chains at opposite sides of the fabric that passes thru a track or rail for stretching and or fixating the fabric as it passes through heated or cooled zones known in the industry as a heat set oven dryer, oven, coater, cooling section or backing system to remove water from the fabric or to cure an adhesive applied to the fabric such as Latex, polyurethanes, PVC, Polyethylene EVA, or UV chemistry desired to secure a tufted or woven fabrics fibers. Additional applications include tentering to treat, cure or dry coatings used as water barriers or coated webs in general where a tenter frame is required. Most tenters by design have the mechanical ability to move in and out to properly stretch to desired and varying widths of carpet or fabric being manufactured. This mechanical movement of the tenter is possible because the tenter is secured or mounted to a width adjustment means commonly referred to as a width spindle or screw adjustment beam. The tenter system is constructed using a chain and rail system where a chain passes thru the rail or track arrangement throughout the curing heating or cooling zones of the process, the chain fixed with a plurality of pin plates that selectively secure to the fabric web.

As the tenter rail system passes through temperature controlled zones of an oven, dryer, or backing system, the tenter track or rail system is subjected to a wide range of temperatures varying between typically 50 degrees and 500 degrees Fahrenheit. As a result of the varying temperatures the metal material of the track or rail expands and contracts. The chain that passes through the rail system tends to distort with the rail and is problematic and not desirable.

What is needed is a device that allows the expansion of the rail or track system in both the direction of and opposite of the fabric or web production flow. Moreover such a device would secure the rails of the tenter so that the rail is encapsulated to assure best possible alignment at each point that it is mounted to a supporting width or screw beam, and would allow for quick and easy replacement when required as the chain and rail system has to be replaced (at end of life). Currently bars are welded to the back of the rail and the bars are bolted to attachment points on the screw beam/spindle carriages. The result would be a longer tenter chain and rail service life and stable dimensional stability of the fabric or carpet width throughout the tenter frame.

SUMMARY OF THE INVENTION

The present device is an expansion joint for use with a tenter system of the type having at least two tenter chain and rail mechanisms adjustably separated by a width adjustment means. Each chain and rail mechanism typically includes at least two elongated sections of a tenter rail that conducts a tenter chain therein.

The expansion joint includes a mounting means adapted for attachment to the tenter width adjustment means of the tenter system. Such a mounting means may be an L-shaped bracket, for example, and include a selectively removable mechanical fastener. Alternately, the mounting means may be fixed to the tenter width adjustment means with a weld.

The expansion joint 10 further includes an elongated C-shaped rail cage adapted to substantially enclose abutting ends of each tenter rail section. Such a rail cage includes a partially open side through which pin plates fixed to the tenter chain may project as the chain moves through the tenter rail. The rail cage is adapted for fixing with the mounting means and receiving slidably through open ends thereof each end of one of the rail sections.

The rail cage preferably includes a removable side selectively secured to the rail cage with at least one mechanical fastener. As such, the side of the rail cage may be removed to access the ends of each section of tenter rail therein. An internal cavity of the rail cage is preferably adapted to fit around the tenter rail with substantially no radial play, such that the tenter rail is only free to move longitudinally therein from end to end without interfering with the movement of the pin plates along the tenter rail.

In use, as the tenter rail sections longitudinally expand and contract due to temperature fluctuations along the tenter rails, the ends of each section are kept in longitudinal alignment by the rail cage. Multiple such expansion joints may be used for a single tenter system, as needed.

The present device allows the expansion of the rail or track system in both the direction of and opposite of the fabric or web production flow. Moreover the expansion joint device completely secures the rails of the tenter so that each rail is encapsulated to assure best possible alignment at each point that it is mounted to a supporting width or screw beam. The result is a longer tenter chain and rail service life and improved dimensional stability of the fabric or carpet width throughout the tenter frame. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
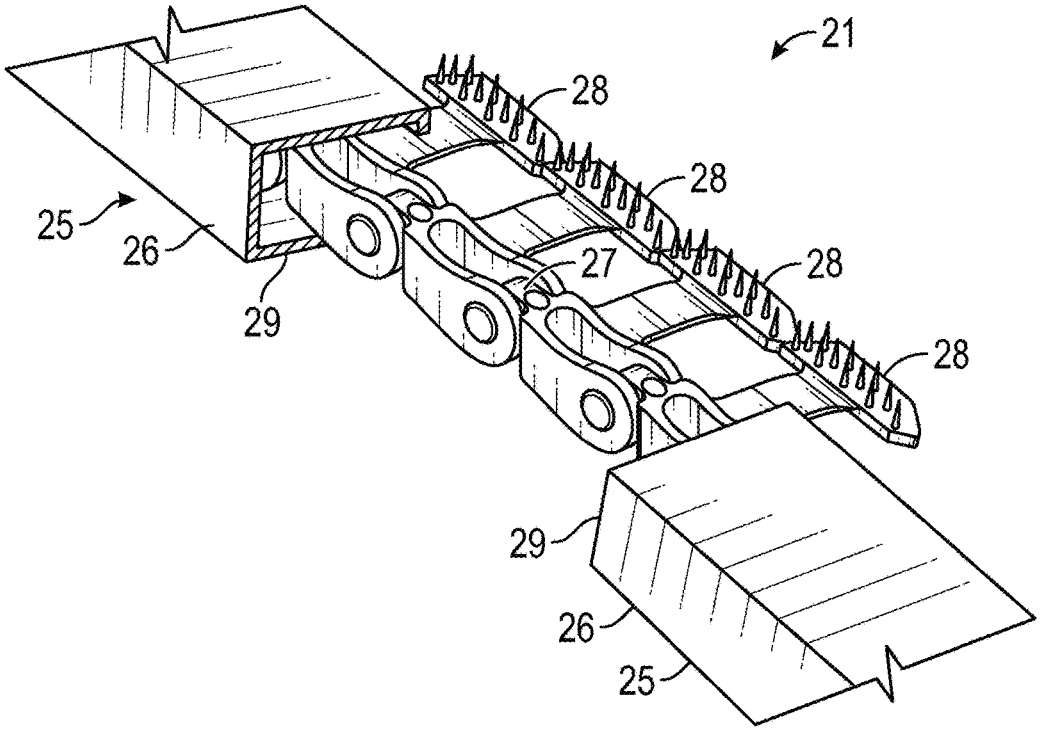
FIG. 1 (Prior Art)
FIG. 1 is a perspective view of a prior art tenter system.
Figure 2:
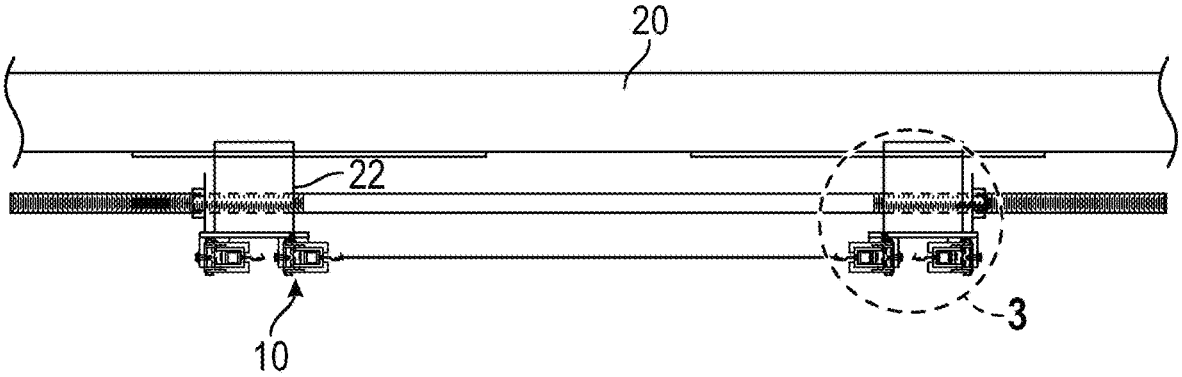
FIG. 2 is an elevation view of a tenter width beam and width adjustment means thereof.
Figure 3:
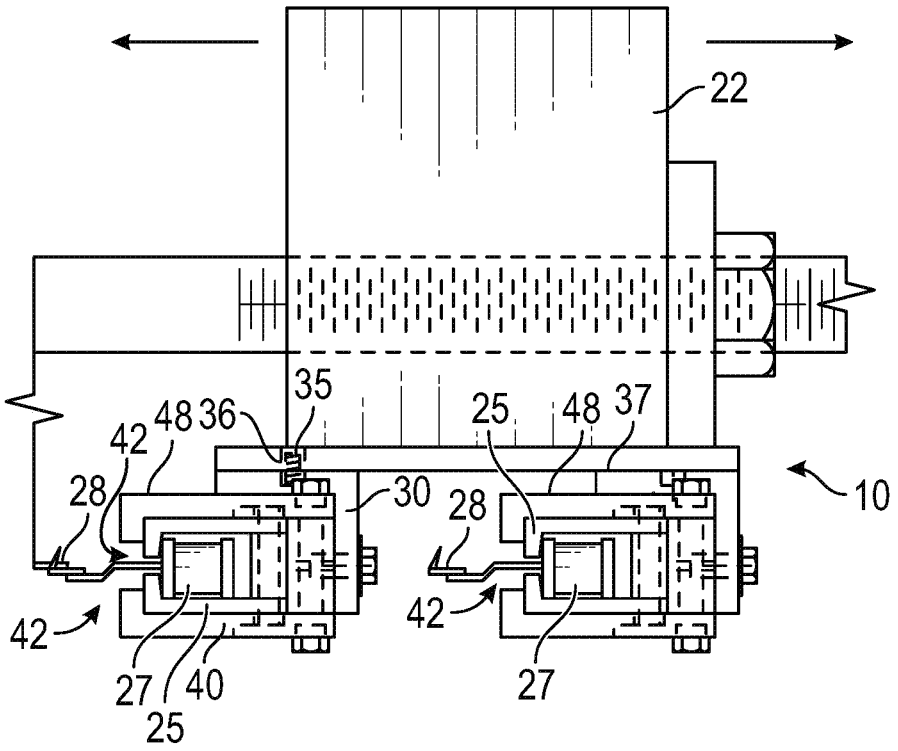
FIG. 3 is an enlarged view of the width adjustment means taken generally along path 3 of FIG. 2.
Figure 7A:
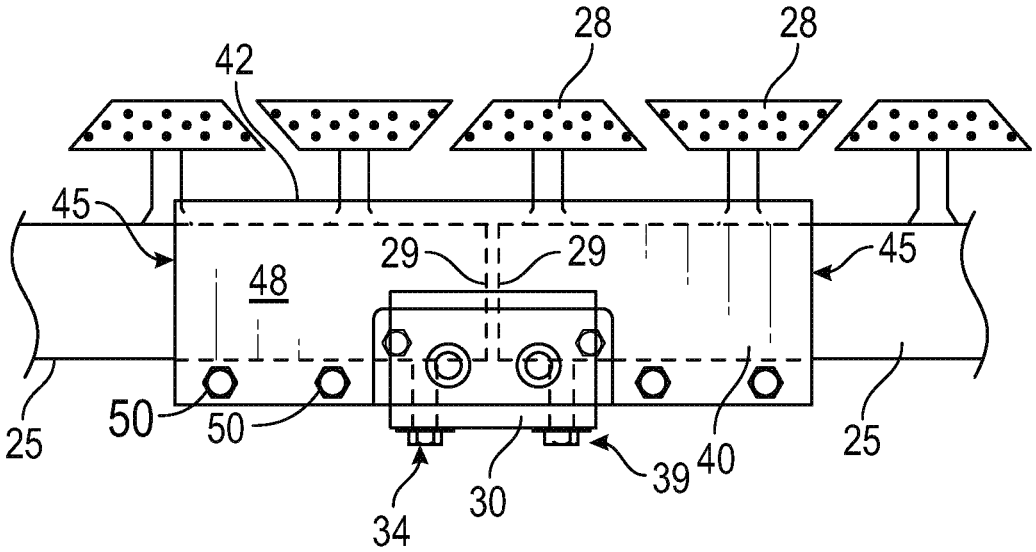
FIG. 7A is a plan view of the invention as mounted around two sections of a tenter rail.

FIGS. 2, 3 and 7A illustrate an expansion joint 10 for use with a tenter system 20 having at least two tenter chain and rail mechanisms 21 adjustably separated by a width adjustment means 22, such as a width adjustment screw (FIG. 2). Each chain and rail mechanism 22 typically includes at least two elongated sections 26 of a tenter rail 25 that conducts a tenter chain 27 therein (FIG. 1).

Figure 4A:
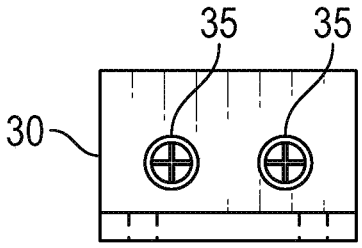
FIG. 4A is a plan view of a mounting means of the invention.
Figure 4B:
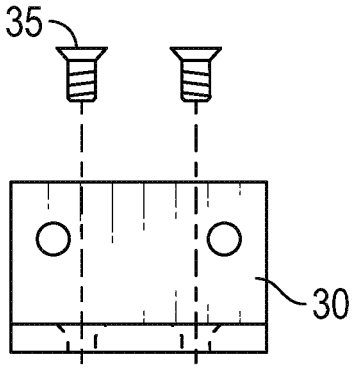
FIG. 4B is an elevation view thereof.
Figure 4C:
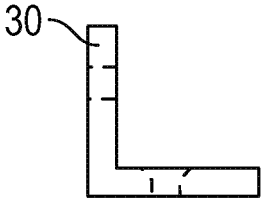
FIG. 4C is a side elevational view thereof.

The expansion joint 10 includes a mounting means 30 adapted for attachment to the tenter width adjustment means 22 of the tenter system 20. Such a mounting means 30 may be an L-shaped bracket 31, for example, and include a selectively removable mechanical fastener 34, such as a threaded flat-head bolt 35 adapted to engaged a threaded aperture 36 formed in the tenter width adjustment means 22 (FIGS. 3-4C).

Alternately, the mounting means 30 may be fixed to the tenter width adjustment means 22 with a weld 37 (FIG. 3). Clearly other suitable means of mounting the L-shaped bracket 31 to the tenter width adjustment means 22 may be used, as is known in the art. Such an L-shaped bracket 31 is preferably made from a strong, rigid metal material, such as steel or iron.

Figure 7B:
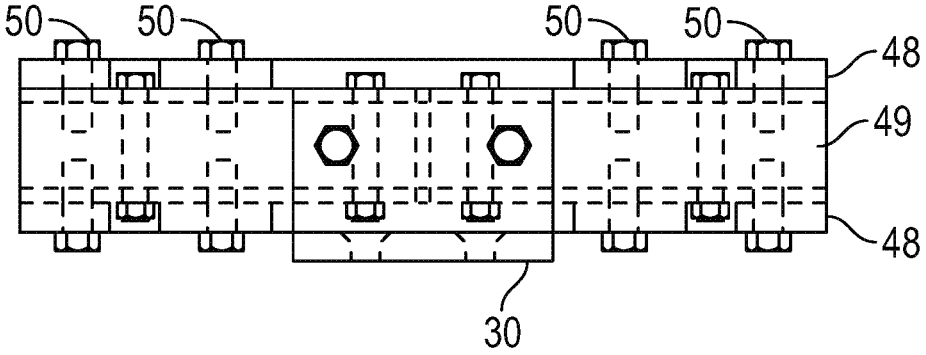
FIG. 7B is a rear elevational view thereof.
Figure 7C:
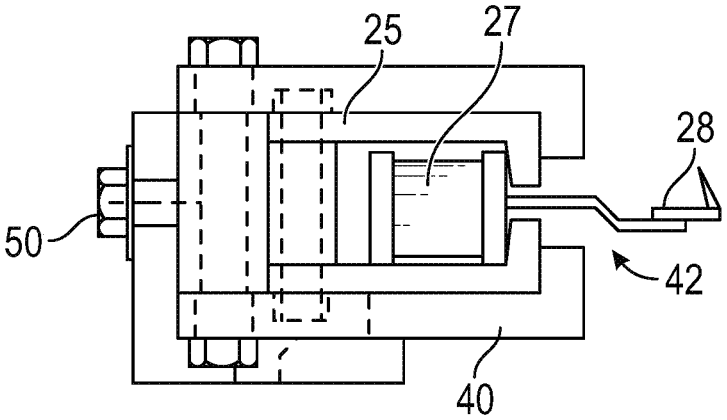
FIG. 7C is a side elevational view thereof.

The expansion joint 10 further includes an elongated C-shaped rail cage 40 adapted to substantially enclose abutting ends 29 of each tenter rail section 26. Such a rail cage 40 includes a partially open side 42 through which pin plates 28 fixed to the tenter chain 27 may project as the chain 27 moves through the tenter rail 25. The rail cage 40 is adapted for fixing with the mounting means 30 and receiving slidably through open ends 45 thereof each end 29 of one of the rail sections 26 (FIGS. 7A-7C). The rail cage 40 is preferably made from a strong, rigid metal material, such as steel or iron.

Figure 5A:
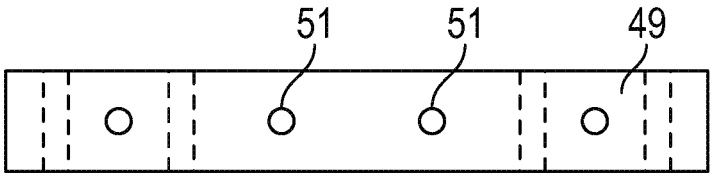
FIG. 5A is a plan view of a rail cage end of the invention.
Figure 5B:
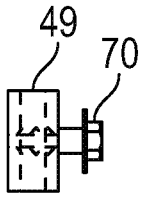
FIG. 5B is a side elevational view thereof.
Figure 5C:
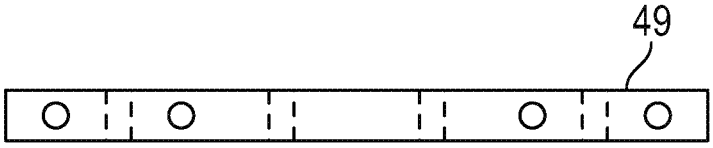
FIG. 5C is a rear elevation view thereof.
Figure 6A:
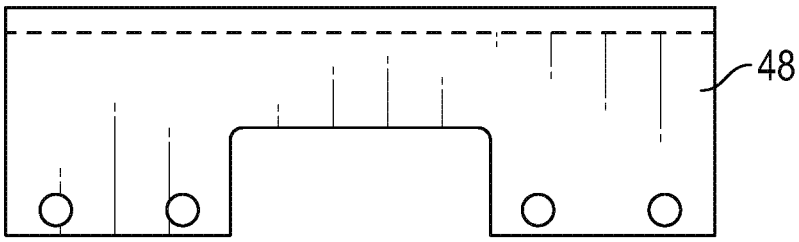
FIG. 6A is a plan view of a removable side of a rail cage.
Figure 6B:
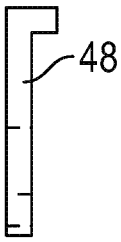
FIG. 6B is a side elevational view thereof.

The rail cage 40 preferably includes a removable side 48 selectively secured to the rail cage 40 with at least one mechanical fastener 50, such as a bolt. As such, the side 48 of the rail cage 40 may be removed to access the ends 29 of each section 26 of tenter rail 25 therein. In one embodiment, the rail cage 40 may comprise two such sides 48 fixed with a cage end 49 (FIGS. 5A-5C) with mechanical fasteners 50, for example. An internal cavity 41 of the rail cage 40 is preferably adapted to fit around the tenter rail 25 with substantially no radial play, such that the tenter rail 25 is only free to move longitudinally therein from end 45 to end 45. In one embodiment, only one of the top or bottom sides 48 of the rail cage 40 includes a lip on the partially open side (not shown).

In use, as the tenter rail sections 26 longitudinally expand and contract due to temperature fluctuations along the tenter rails 25, the ends 29 of each section 26 are kept in longitudinal alignment by the rail cage 40. One such expansion joint 10 may be fixed around each end of each tenter rail section 26 of the tenter system 20, including any chain return sections 19 thereof (FIGS. 2 and 3). Thus, multiple expansion joints 10 may be used for a single tenter system 20, as needed.

While a particular form of the invention has been illustrated and described, it will be apparent that various modifications can be made without departing from the spirit and scope of the invention. For example, a particular shape of the cavity 41 has been illustrated, but any suitable shape of cavity 41 can be used according to the shape of the tenter rail 25 of the tenter system 20. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An expansion joint for use with a tenter system having at least two tenter chain and rail mechanisms adjustably separated by a width adjustment means, each chain and rail mechanism including at least two elongated sections of a tenter rail that conducts a tenter chain therein, the expansion joint comprising:

a mounting means adapted for attachment to the width adjustment means of the tenter system;

an elongated C-shaped rail cage adapted to substantially enclose abutting ends of each tenter rail section, the elongated C-shaped rail cage including a partially open side through which pin plates fixed to the tenter chain may project as the chain moves through the tenter rail, the elongated C-shaped rail cage adapted for fixing with the mounting means and receiving slidably through open ends thereof each end of one of the rail sections, the elongated C-shaped rail cage including a removable side selectively secured to the elongated C-shaped rail cage with at least one mechanical fastener, whereby the side of the elongated C-shaped rail cage may be removed to access the ends of each section of tenter rail therein;

whereby as the tenter rails longitudinally expand and contract, the ends of each section thereof are kept in longitudinal alignment by the elongated C-shaped rail cage.

2. The expansion joint of claim 1 wherein the mounting means is a metal bracket that includes at least one selectively removable mechanical fastener.

3. The expansion joint of claim 2 wherein each selectively removable mechanical fastener is a threaded flat-head bolt adapted to screw into a threaded aperture formed in the width adjustment means.

4. The expansion joint of claim 1 wherein an internal cavity of the rail cage is adapted to fit around the tenter rail with substantially no radial play, such that the tenter rail is only free to move longitudinally therein.

* * * * *